US011841200B2

(12) United States Patent
Velasquez

(10) Patent No.: US 11,841,200 B2
(45) Date of Patent: Dec. 12, 2023

(54) SINGLE-ACTION TRIGGER

(71) Applicant: Mythic Mechanisms, LLC, Lauderdale by the Sea, FL (US)

(72) Inventor: Gene Anthony Velasquez, Cambridge, MA (US)

(73) Assignee: Mythic Mechanisms, LLC, Lauderdale by the Sea, FL (US)

( * ) Notice: Subject to any disclaimer, the term of this patent is extended or adjusted under 35 U.S.C. 154(b) by 0 days.

(21) Appl. No.: 17/806,092

(22) Filed: Jun. 9, 2022

(65) Prior Publication Data

US 2022/0397359 A1 Dec. 15, 2022

Related U.S. Application Data

(60) Provisional application No. 63/208,611, filed on Jun. 9, 2021.

(51) Int. Cl.
*F41A 19/31* (2006.01)

(52) U.S. Cl.
CPC ..... *F41A 19/31* (2013.01)

(58) Field of Classification Search
CPC ..... F41A 19/15; F41A 19/25; F41A 19/27; F41A 19/29; F41A 19/31; F41A 19/32; F41A 17/56; F41A 17/72
USPC ..... 42/69.02; 89/144, 146, 147
See application file for complete search history.

(56) References Cited

U.S. PATENT DOCUMENTS

| | | | | |
|---|---|---|---|---|
| 339,301 | A | 4/1886 | Johnson et al. | |
| 4,539,889 | A | 9/1985 | Glock | |
| 4,825,744 | A | 5/1989 | Glock | |
| 4,893,546 | A | 1/1990 | Glock | |
| 5,701,698 | A | 12/1997 | Wesp et al. | |
| 10,030,927 | B1 * | 7/2018 | Theiss | F41A 19/12 |
| 11,187,483 | B2 | 11/2021 | O'Clair | |
| 2015/0323274 | A1 * | 11/2015 | Toner | F41A 17/56 42/70.01 |
| 2017/0184366 | A1 * | 6/2017 | Zajk | F41A 21/00 |
| 2018/0187994 | A1 * | 7/2018 | Carr | F41A 19/30 |

FOREIGN PATENT DOCUMENTS

JP 5935371 B2 6/2016

OTHER PUBLICATIONS

Timney Triggers, Alpha Competition Series for Glock Colored Race Gun Triggers Gen 5, <https://timneytriggers.com/alpha-competitions-series>. . . ; printed May 31, 2022 (8 pages).

* cited by examiner

*Primary Examiner* — Bret Hayes
(74) *Attorney, Agent, or Firm* — Wood Herron & Evans LLP

(57) ABSTRACT

Provided is a single-action trigger assembly that includes a pivoting trigger member, a sear/disconnector mechanism, and a trigger bar operably connecting the trigger member and the sear/disconnector mechanism. The sear/disconnector mechanism includes a slider assembly longitudinally reciprocated by the trigger bar. The slider assembly includes a tripper member carried on a slider frame that, when the trigger is pulled, moves a sear trip member to allow displacement of a sear and release a striker.

10 Claims, 17 Drawing Sheets

SINGLE-ACTION TRIGGER

RELATED APPLICATION

This Non-Provisional patent application claims priority to U.S. Provisional Patent Application No. 63/208,611, filed Jun. 9, 2021, the entirety of which is incorporated by reference herein.

TECHNICAL FIELD

This invention relates to a firearm trigger mechanism. In particular, it relates to a single-action trigger that has multiple internal safeties and that can replace another type of OEM handgun trigger mechanism as a drop-in unit.

BACKGROUND

The Glock-pattern handgun has become ubiquitously popular around the world since it was first introduced by Glock® in 1982. This pattern is striker-fired and uses a "safe-action" trigger mechanism that holds the striker in a partially cocked position (generally shown and described in U.S. Pat. No. 4,539,889) which is then fully cocked when the trigger is pulled, until released by the sear. This shortens the required trigger pull compared to a double-action type, but is believed to provide some added degree of safety over other trigger designs. A double-action trigger moves the striker (or hammer) from an uncocked position to a cocked position, requiring the trigger to be pulled a significant distance before releasing the sear. A single-action trigger holds the striker (or hammer) in a fully cocked position and requires only a short trigger pull distance to release the sear.

When pulling of the trigger also moves the striker to a fully cocked position (either from an uncocked or partially cocked position), the force of the striker spring directly affects the force required to pull the trigger. The addition of intermediate components can reduce the user's mechanical effort to pull the trigger and release the striker. Or, lightening of the striker spring will also reduce the mechanical effort required to pull the trigger, but significantly reduces the striker force when released from the cocked position. This can cause misfires and malfunctions when the reduced force of the released striker is too light to ignite the primer of the cartridge. Intermediate elements between the trigger and the striker can reduce the mechanical effort of the trigger pull without modifying the spring force of the striker, but still require the trigger to be pulled a significant distance before releasing the sear.

For various reasons, some users of handguns prefer to have the benefits of a single-action trigger. This includes users of the Glock®-pattern handgun who would like to have these advantages without giving up other benefits of the platform and without sacrificing safety in the event it is dropped or there is a mechanical failure.

SUMMARY OF THE INVENTION

The present invention provides a single-action trigger mechanism with intermediate elements between the trigger bar and the striker, reducing the mechanical effort of the trigger pull without modifying the spring force of the striker.

The trigger assembly includes a pivoting trigger connected to a sear/disconnector assembly by a trigger bar. The sear/disconnector assembly includes a slider assembly that is moved longitudinally by the trigger bar in a guide channel of a housing. The slider assembly includes a tripper member that releasably engages a sear trip lever that holds a sear in a set position. When the slider is reciprocated to the rear, the tripper member pulls the sear trip lever to release the sear, allowing the striker to be released from its cocked position.

Principles of this present disclosure can be applied to striker-fired handguns, rifles, machine guns, and shotguns.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
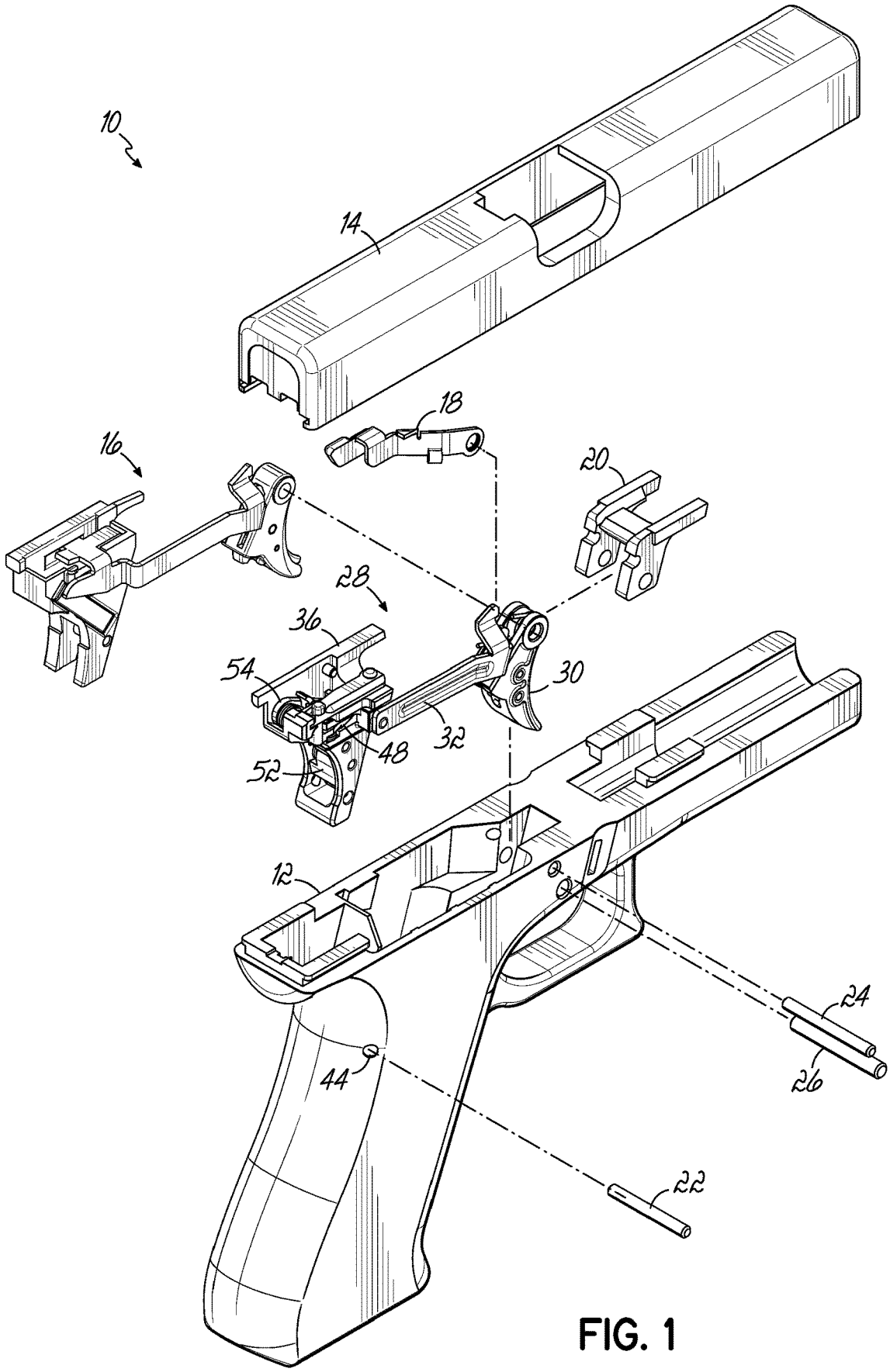
FIG. 1 is an exploded isometric view of a Glock®-pattern handgun showing both an OEM trigger assembly and a single-action trigger assembly according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Although the mechanical and functional principles of this invention may be adapted to most any striker-fired firearm or firearm platform, the illustrated embodiment is designed to allow drop-in replacement of a standard OEM "safe-action" trigger mechanism for a Glock-pattern handgun to provide a drop-safe, single-action replacement trigger mechanism without replacement or modification of any other parts.

As is well-known to a person of ordinary skill in the design, a Glock-pattern trigger assembly 16 includes a pivoting trigger, a sear/disconnector mechanism in a housing, and a trigger bar that interconnects the trigger to the sear/disconnector mechanism. The housing fits into a socket in the handgun frame and is fixed to it by an assembly pin 22. The trigger is pivotally mounted to the frame with a removable pivot pin 26. The blade of the trigger includes a spring-loaded safety member that prevents movement of the trigger (and, thereby, firing of the weapon) unless the safety is first displaced. The trigger safety abuts a portion of the frame 12 to prevent trigger rotation until it is pivoted to the firing position. This structural concept and function are well-known in the art and were shown, for example, in U.S. Pat. No. 333,301, issued Apr. 6, 1886.

Because of how the trigger bar is pivotally connected to the trigger (at a pivoting point radially offset from the trigger's axis of rotation), pulling the trigger causes the trigger bar's pivot point and the trigger bar to move both rearward and upward, the latter movement lifting and displacing a striker safety according to a well-known operation. In a "safe-action" trigger mechanism, rearward movement of the trigger bar actuates the sear/disconnector mechanism to further retract and then release the striker. In the present invention, the striker is held in a fully cocked position and upward movement of the trigger bar displaces the striker safety and rearward movement actuates the mechanism to release the cocked striker in a single action.

Referring first to FIG. 1, therein as shown at 10 a Glock-pattern handgun, which includes a frame 12, a slide assembly 14, and an OEM "safe-action" trigger assembly 16. Also shown are a slide catch 18, locking block 20, assembly pins 22, 24, and a trigger pivot pin 26. FIG. 1 also shows a trigger assembly 28 according to an embodiment of the present invention. As depicted, the illustrated embodiment single-action trigger assembly 28 is a "drop-in" replacement for the OEM Glock-pattern "safe-action" trigger assembly 16.

Figure 2A:
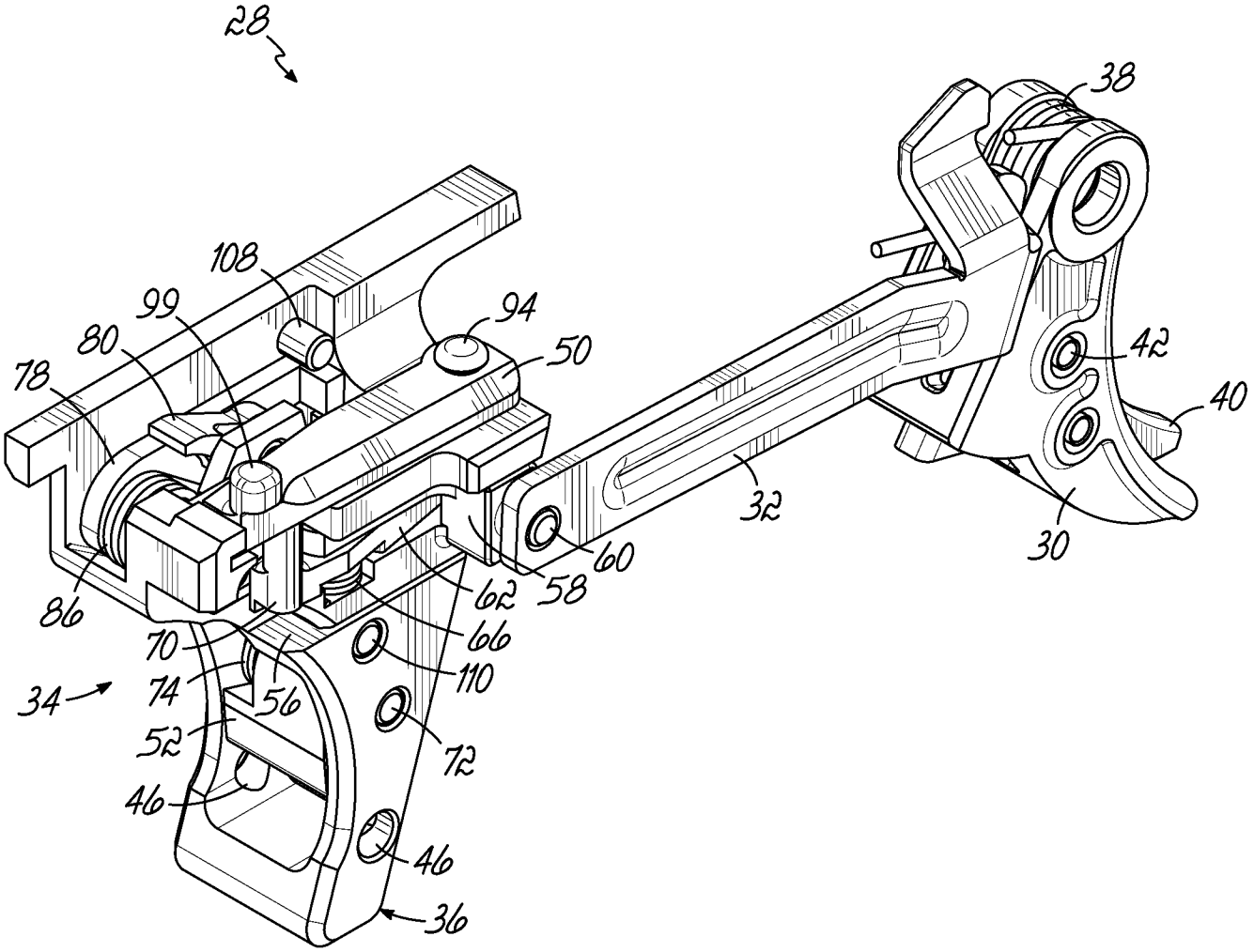
FIG. 2A is an isometric view of a trigger assembly according to an embodiment of the present invention.
Figure 2B:
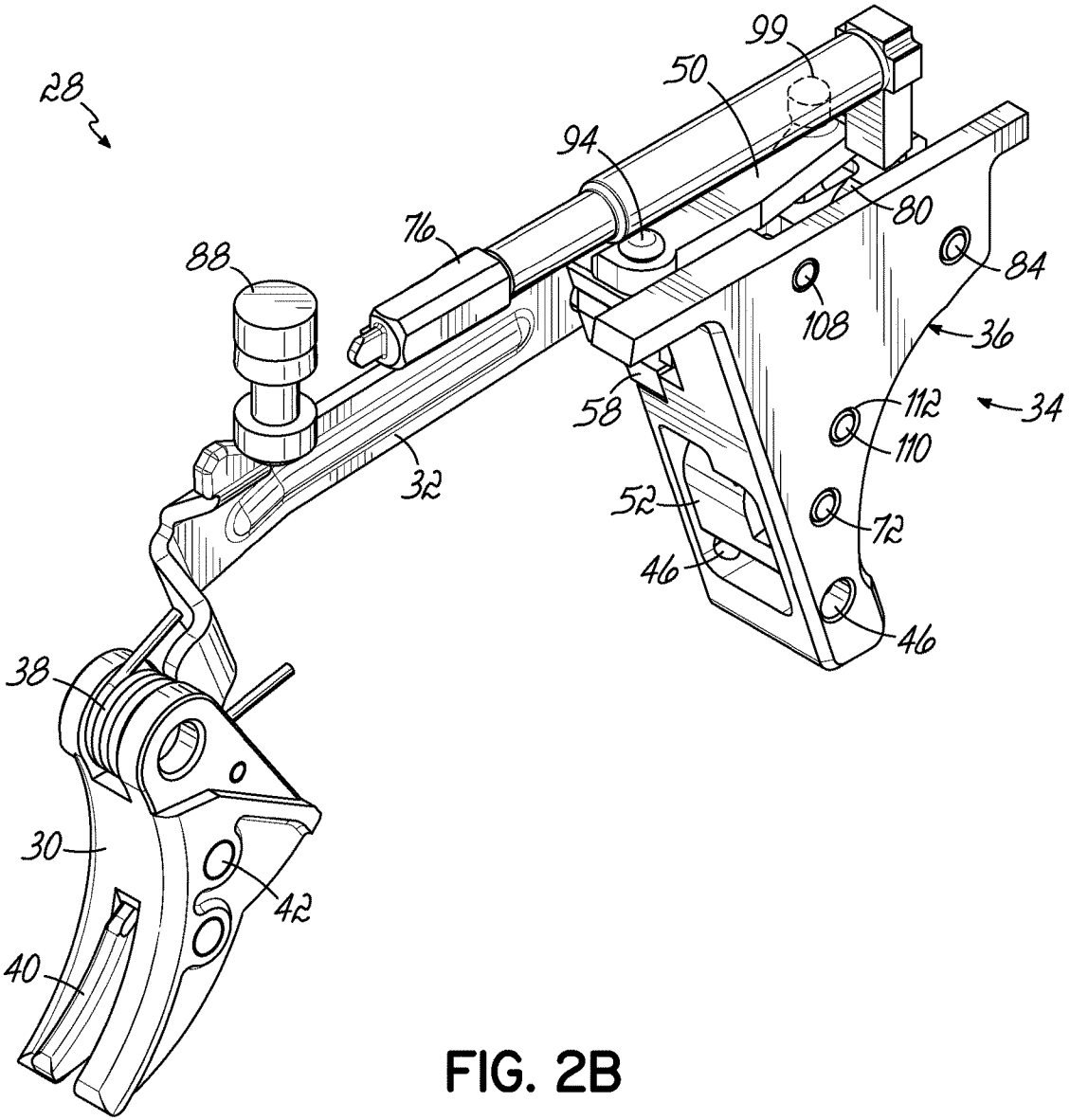
FIG. 2B is an opposite isometric view thereof, also showing the striker and striker safety.

Referring now to FIGS. 2A and 2B, the present trigger assembly 28 includes a trigger member 30, trigger bar 32, and trigger sear/disconnector mechanism 34 supported by a trigger housing 36. The trigger member 30, when installed in the frame 12 to pivot on the pivot pin 26, is biased by a spring 38 toward the set position. The trigger member 30 pivotably carries a safety lever 40 that operates substantially according to the well-known Glock-pattern structure described above and is not essential to the present invention. The trigger bar 32 is pivotally connected to the trigger member 30 via a pivoting connection 42 that is radially offset from the pivot axis (trigger pivot pin 26) of the trigger member 30. As previously described when the trigger member 30 is pivotably actuated (pulled), the trigger bar 32 is moved both rearwardly and upwardly at its forward end. The trigger bar 32 is, in turn, pivotally connected to actuate the trigger sear/disconnector mechanism 34, the operation of which will be explained in greater detail below.

Figure 3:
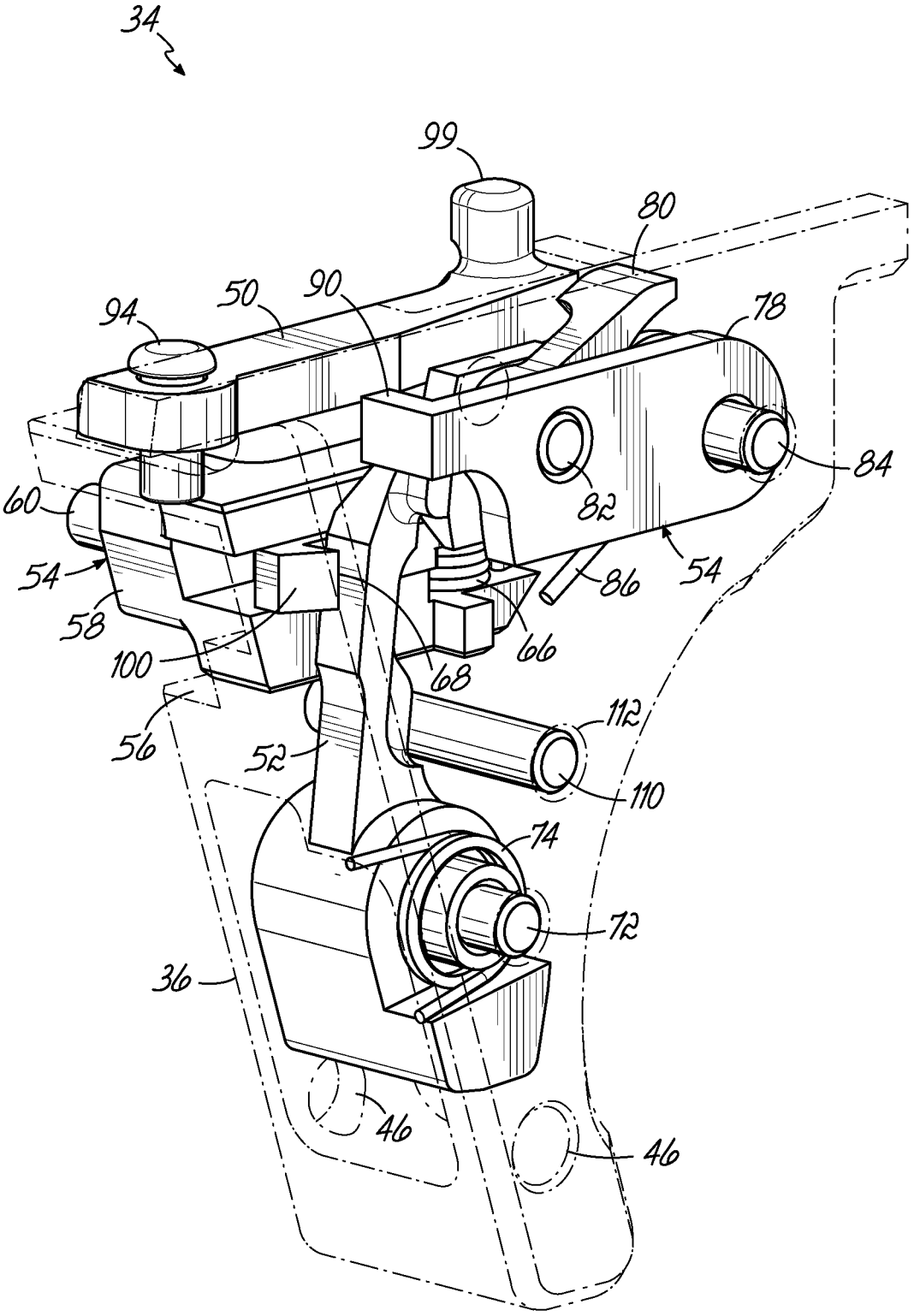
FIG. 3 is an enlarged isometric view of the trigger mechanism with the trigger housing shown in phantom line.
Figure 4:
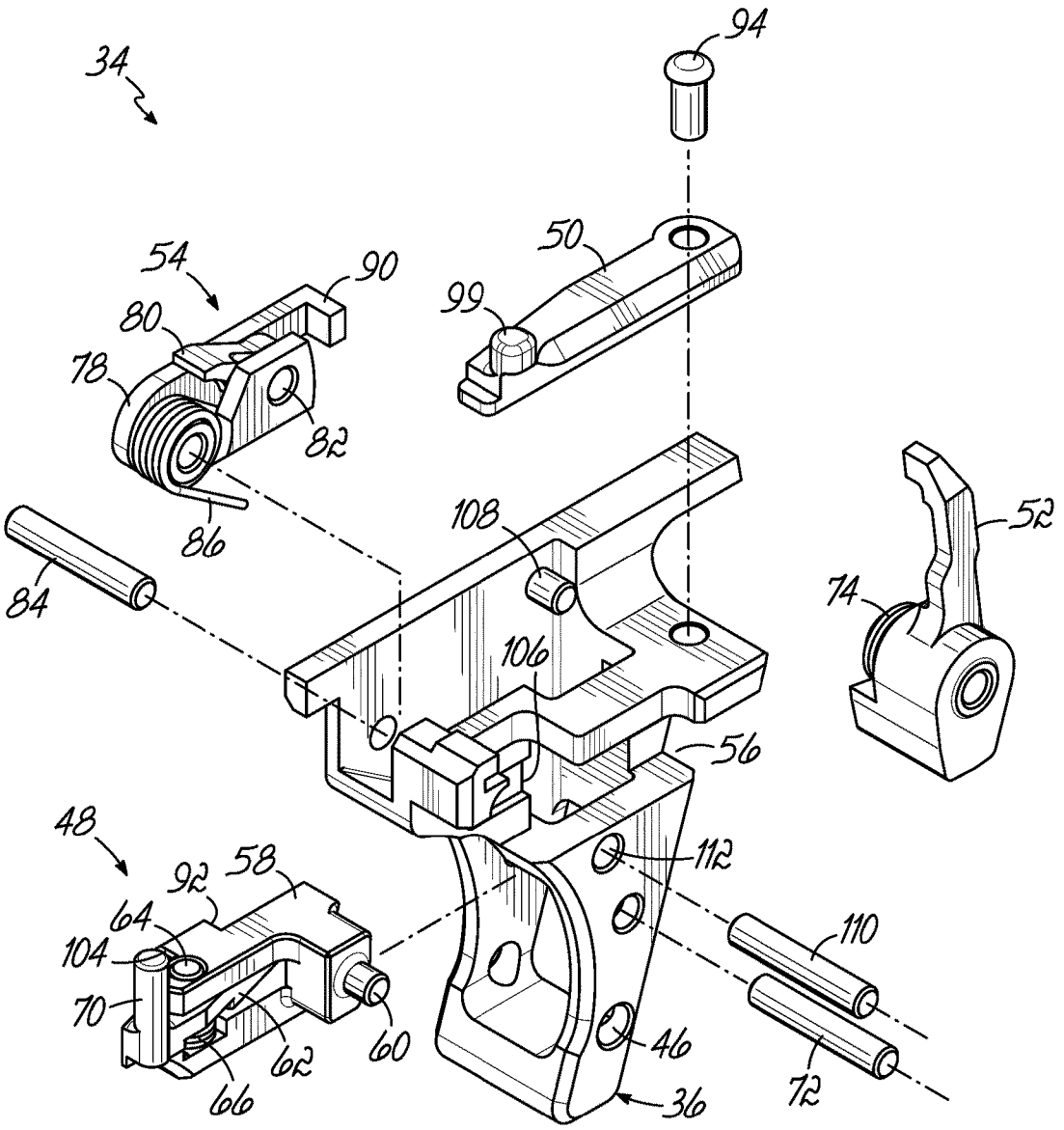
FIG. 4 is a first exploded isometric view of the trigger mechanism.
Figure 5:
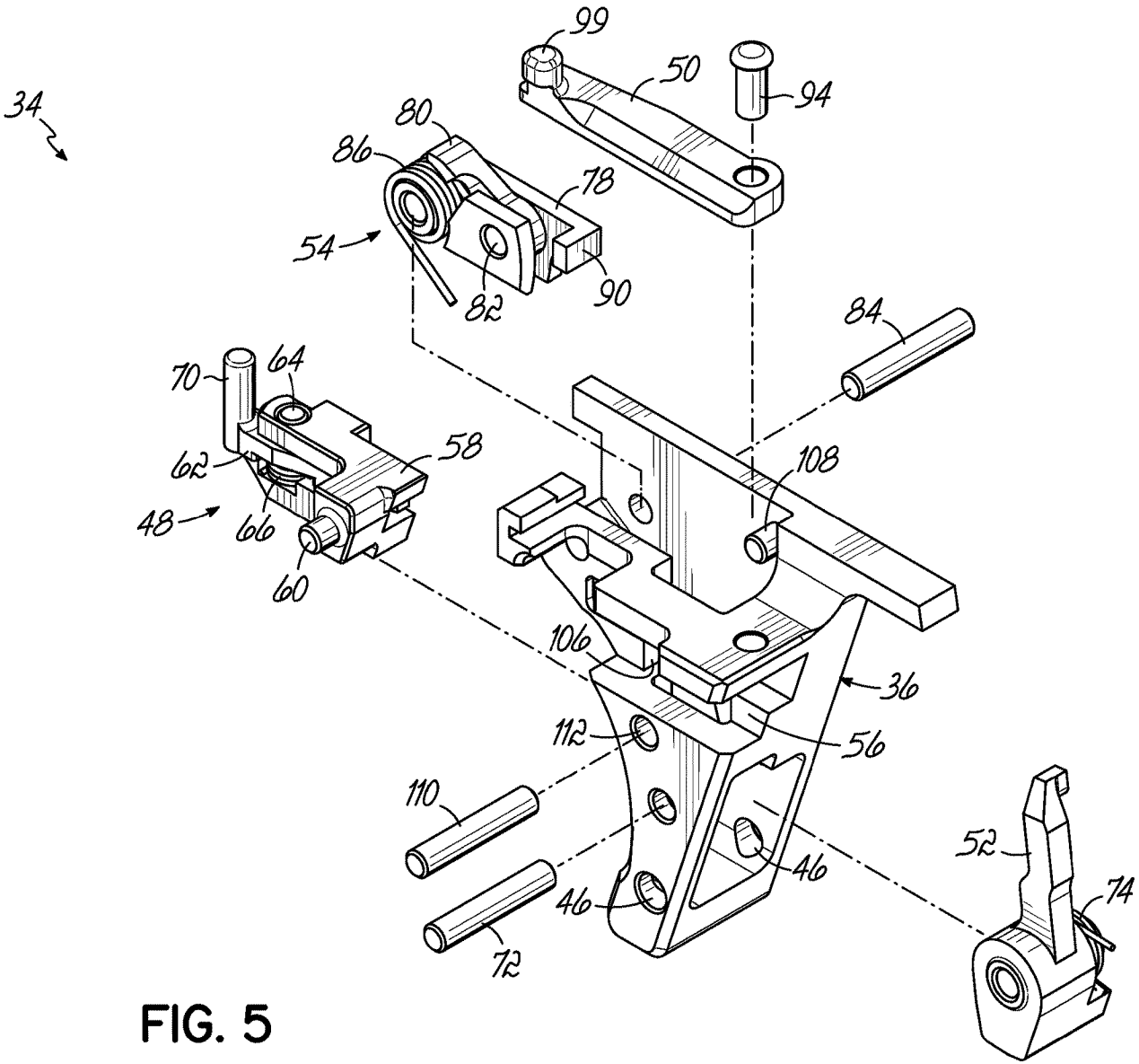
FIG. 5 is another exploded isometric view thereof.

Referring now also to FIGS. 3-5, the trigger sear disconnector mechanism 34 is contained as an assembly in the housing 36 which, as described above, may be configured to interchangeably fit and replace the housing of an OEM Glock-pattern "safe-action" trigger assembly 16. The housing 36 is secured to the frame 12 with an assembly pin 22 that extends through openings 44 in the frame 12 and corresponding openings 46 in the housing 36. The housing 36 carries a slider assembly 48, a disconnector 50, a sear trip lever 52, and a sear assembly 54. The slider assembly 48 is a unit configured to be slidably received and carried in a guide channel 56 of the trigger housing 36 for longitudinal reciprocal movement, actuated by movement of the trigger bar 32.

Figure 6:
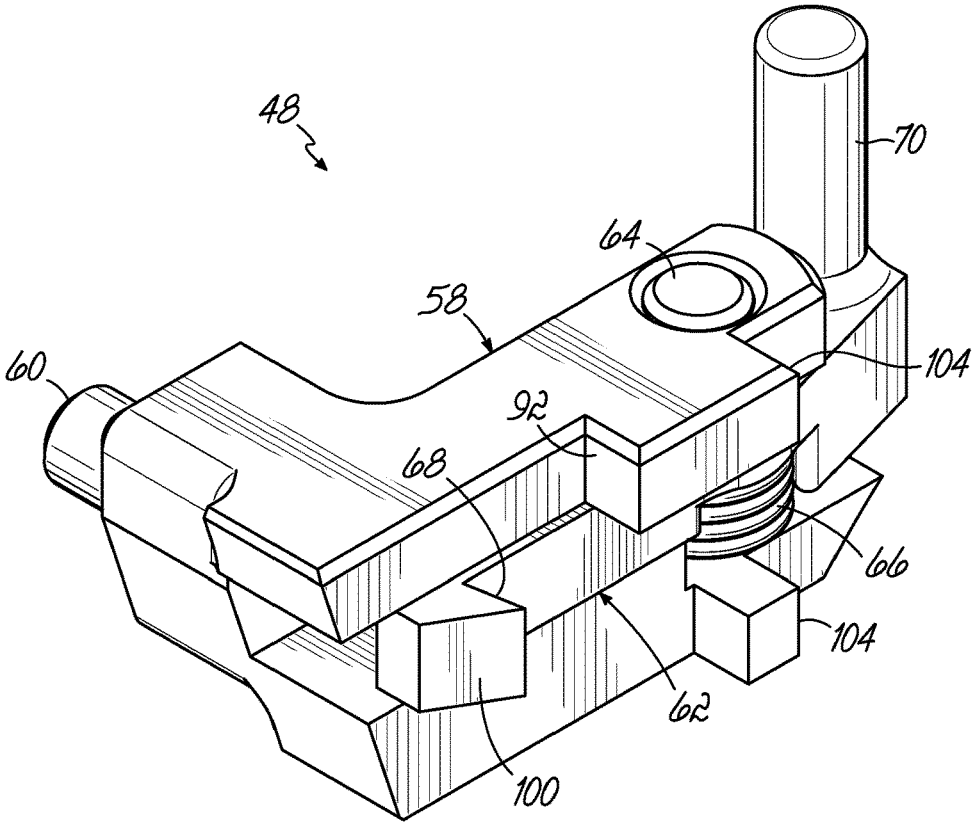
FIG. 6 is a first isometric view of a slider assembly.
Figure 7:
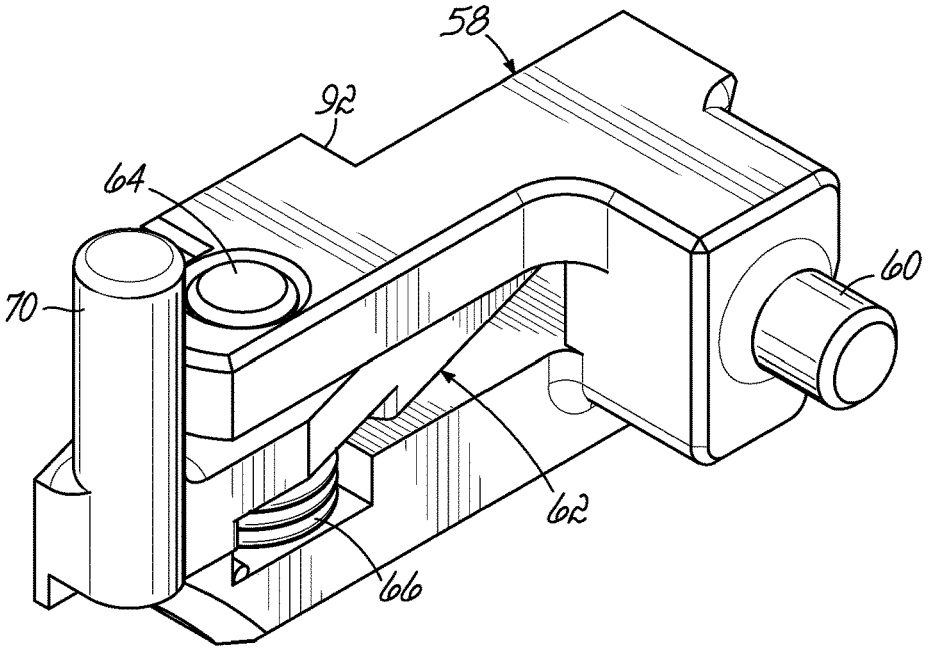
FIG. 7 another isometric view thereof.
Figure 8:
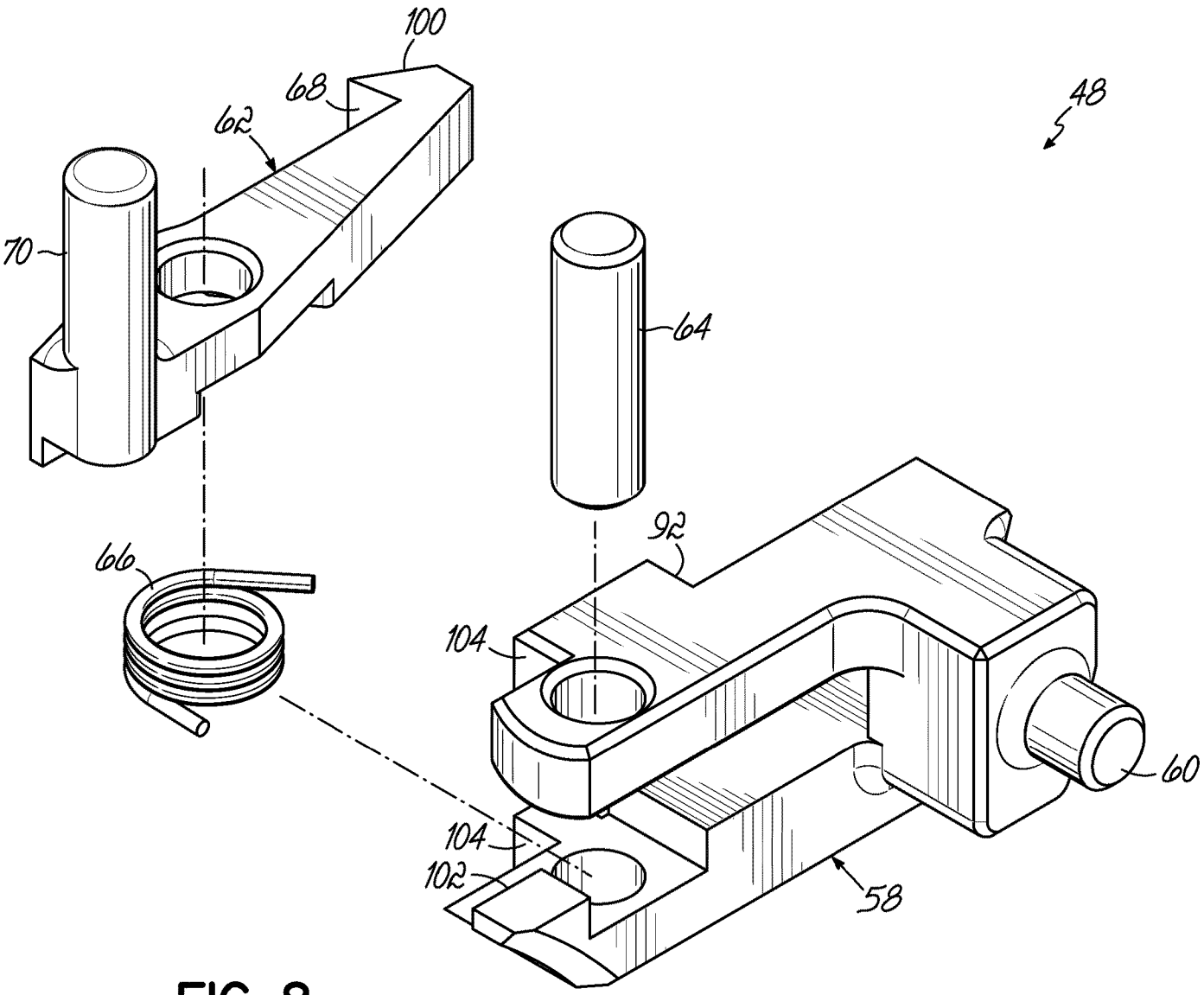
FIG. 8 is an exploded view thereof.

Referring now also to FIGS. 6-8, the slider assembly 48 includes a slider frame 58 with a lateral lug 64 for pivotal connection to the rearward end of the trigger bar 32 (as shown in FIG. 2A). This fixed or separable pivot connection may be accomplished in a variety of known ways not critical to the structure or function of the present invention. A tripper member 62 is carried by the slider frame 58 and is mounted with a substantially vertical pivot pin 64. The tripper member 62 acts as a lever arm with a hook portion 68 at one (forward) end and a tripper dog 70 at the opposite end, and the member 62 pivots on the pin 64 at a midpoint therebetween. The tripper member 62 is biased by a torsion spring 66 toward an engagement position, as shown in FIGS. 3, 6, and 7.

Figure 9:
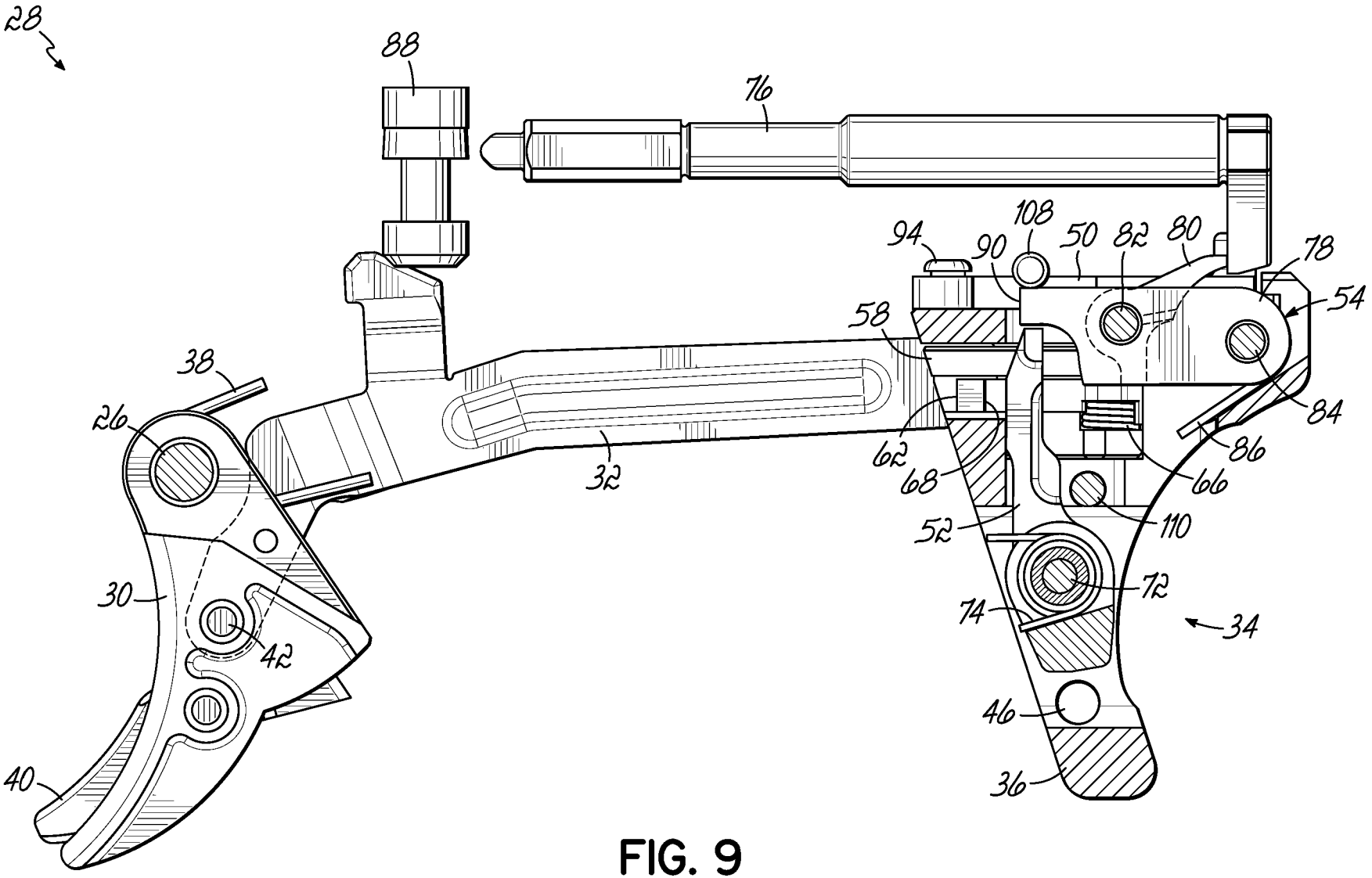
FIG. 9 a partially cut-away side view of the trigger assembly, striker, and striker safety in the set/cocked position.
Figure 10:
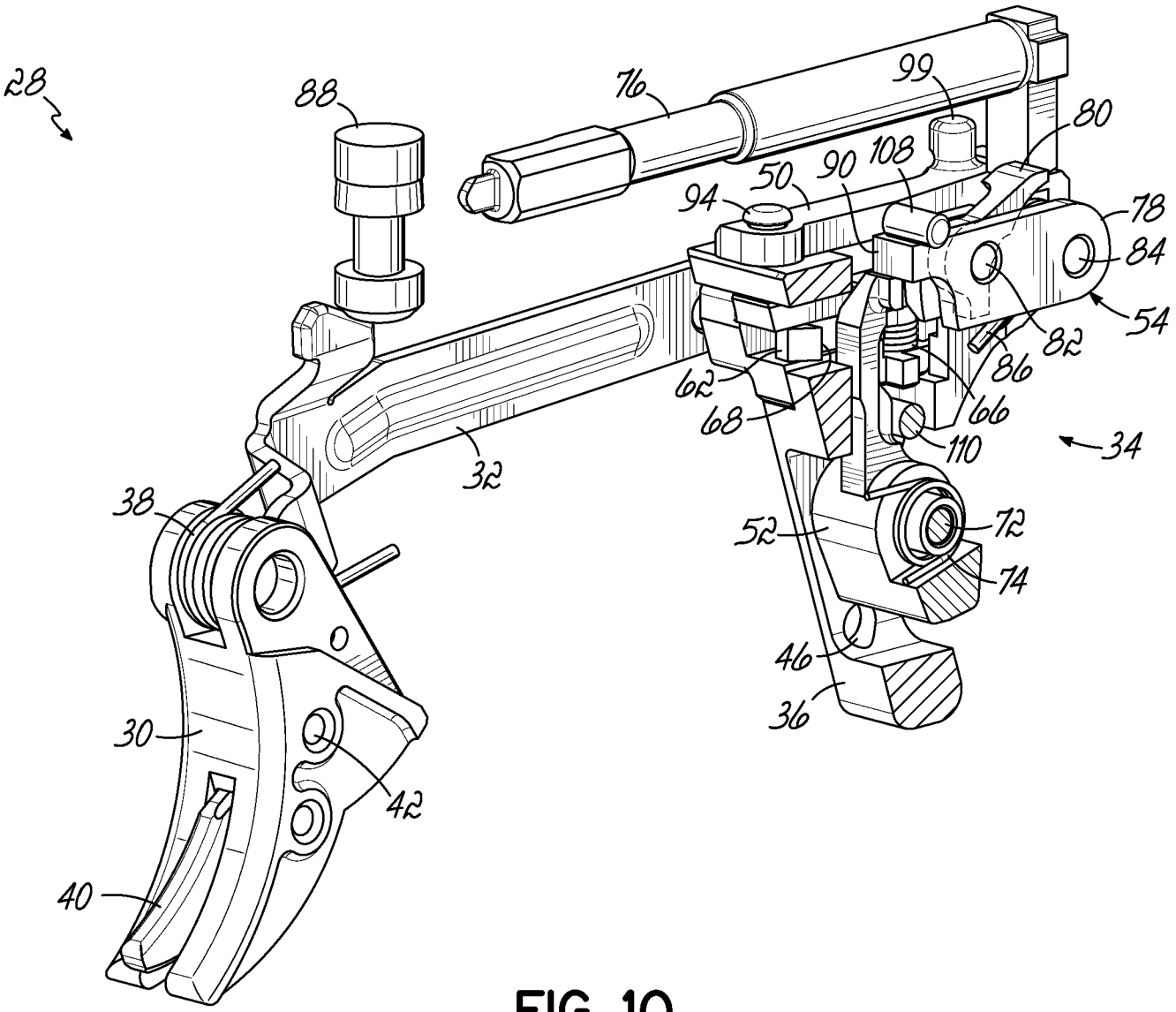
FIG. 10 is a partially cut-away isometric view similar to FIG. 9.

Referring now also to FIGS. 9 and 10, the trigger mechanism 34 includes a sear trip lever 52 that is mounted on a substantially transverse pivot pin 72 carried by the housing 36. The sear trip lever 52 is biased by a torsion spring 74 toward a set position, as shown in FIGS. 9 and 10. The sear trip lever 52 holds the sear assembly 54 in the set position, which engages a catch leg of the striker 76 and holds it in the cocked position (FIGS. 9 and 10).

Figure 11:
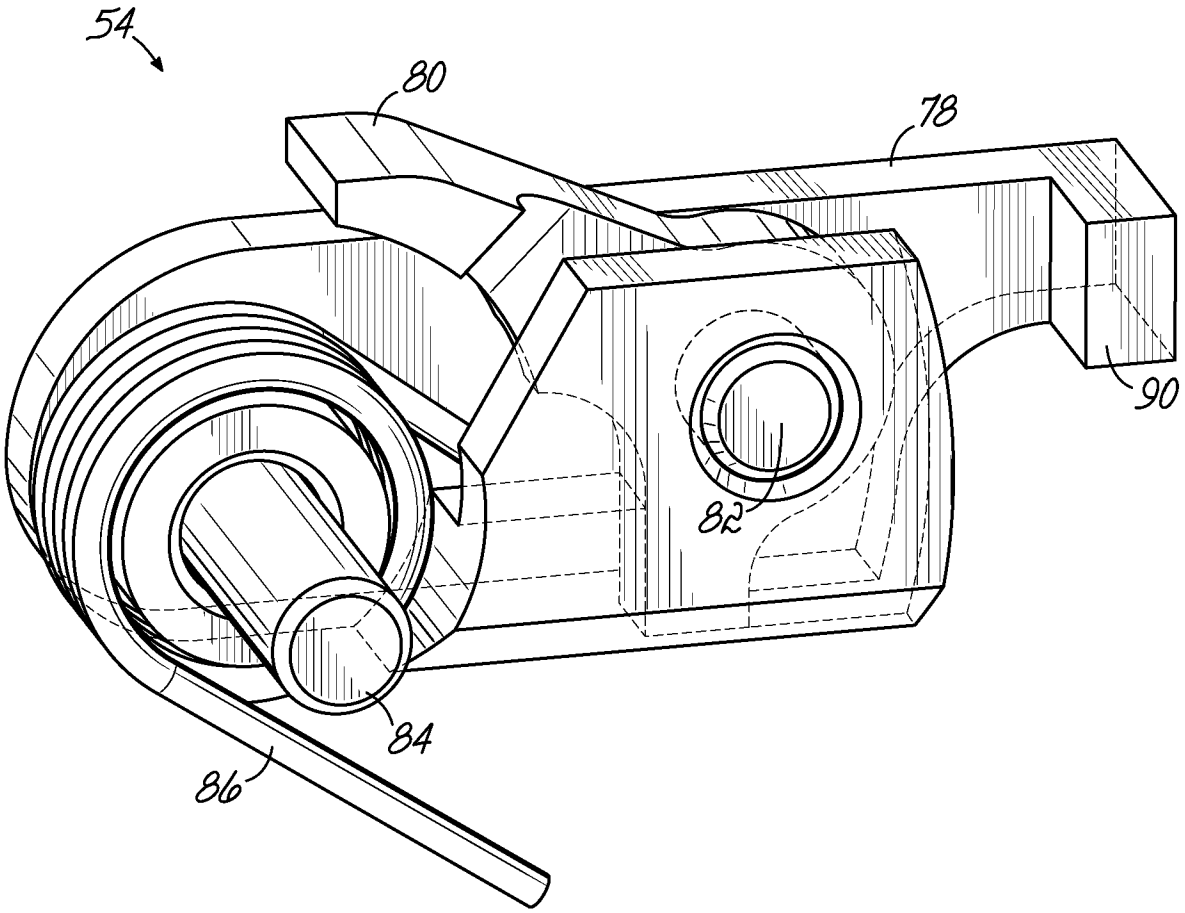
FIG. 11 is an isometric view of the sear assembly with internal structure shown in phantom line.

As shown in FIG. 11, the sear assembly 54 includes a sear carrier 78 and a sear member 80 pivotably mounted on the sear carrier 78 by a pivot pin 82. The sear carrier 78 is pivotally supported on the trigger housing 36 by a fixed pivot pin 84. A torsion spring 86 biases both the sear carrier 78 and sear member 80 toward the set position (FIG. 11). The sear 80 holds the striker 76 in the cocked position until the sear carrier 78 is released by the sear trip lever 52. When the sear carrier 78 is released, the spring force of the striker 76 against the sear 80 overcomes the lesser force of the sear spring 86, causing the sear carrier 78 (with the sear 80) to pivot on its pivot pin 84, releasing the striker 76 (FIG. 12).

Figure 12:
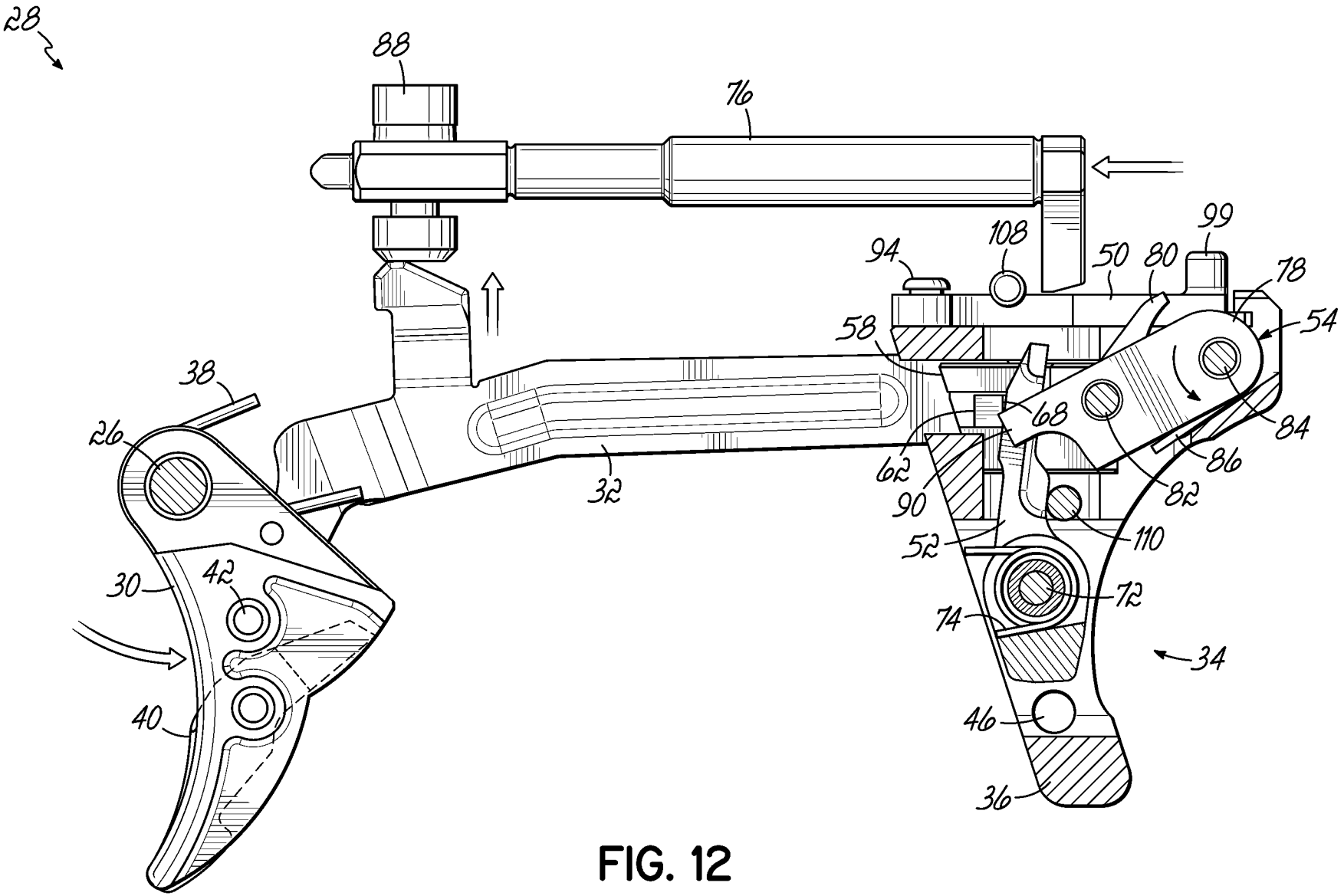
FIG. 12 is a partially cut-away side view similar to FIG. 9, but in a fired position.
Figure 13:
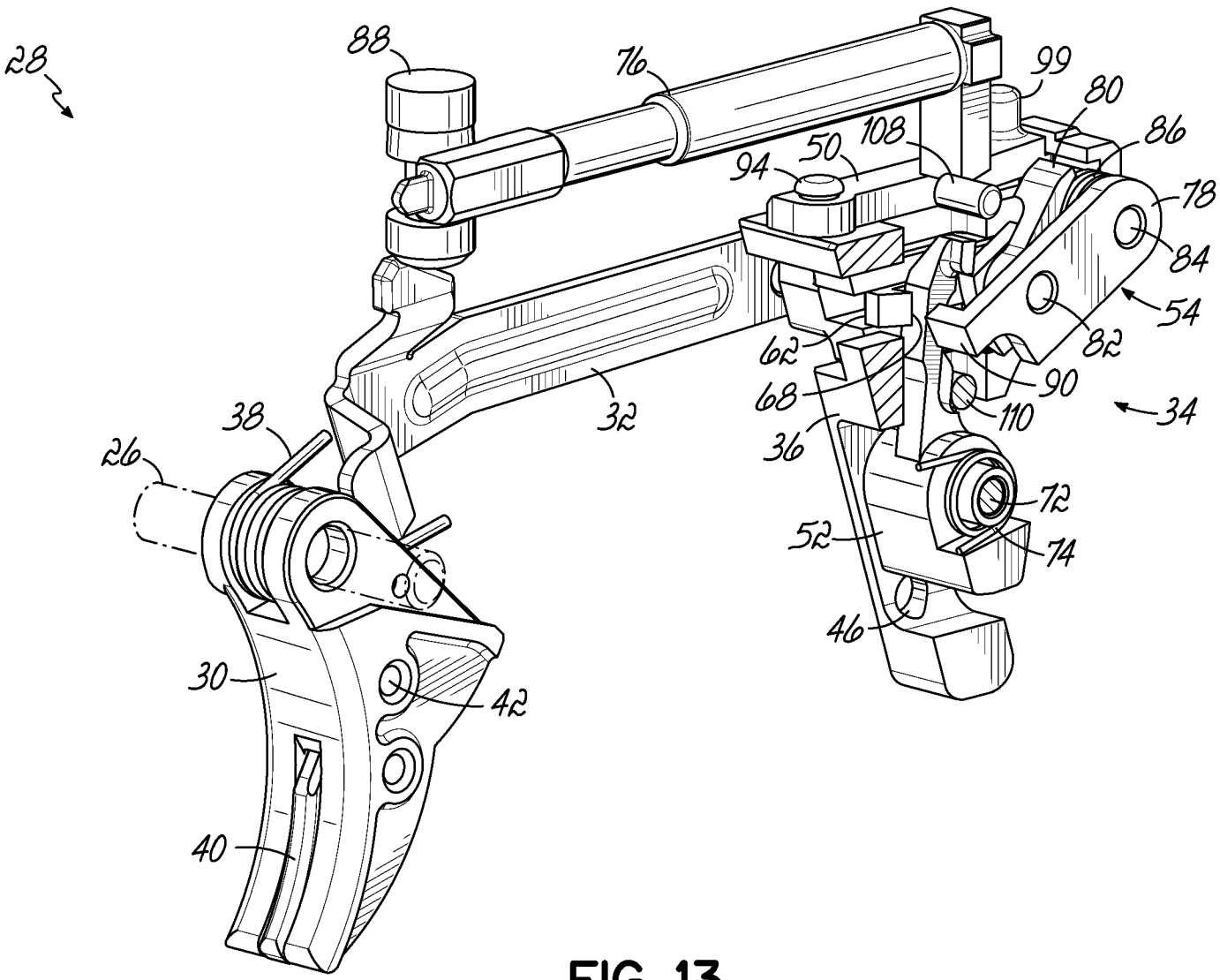
FIG. 13 is a partially cut-away isometric view similar to FIG. 10, but in a fired position.

Referring now to FIGS. 12 and 13, when the trigger 30 is pulled (with the trigger safety 40 displaced), it pivots about the axis of the trigger pivot pin 26 against the force of the trigger spring 38. Pivoting the trigger 30 causes the trigger bar 32 to move both rearwardly and upwardly, as previously described and shown by arrows in FIG. 12. The upward component of the movement causes displacement of the striker safety 88 to allow subsequent movement of the striker 76 into firing contact with a cartridge (not shown). Rearward movement of the trigger bar 32 causes the slider assembly 48 to be linearly displaced rearwardly in the guide channel 56 of the trigger housing 36. Rearward movement of the slider frame 58 carries with it the tripper member 62, which has a hook portion 68 that engages an upward extension of the sear trip lever 52. This pivots the sear trip lever 52 rearward, as shown in FIGS. 12 and 13. This pivoting displacement of the sear trip lever 52 causes its upper end to disengage from a forward arm portion 90 of the sear carrier 78, allowing the sear assembly 54 to be forced to pivot downward by the spring force of the striker 76 against the lesser force of the sear torsion spring 86. As soon as the striker 76 has been released from and passes the sear 80, the sear carrier 78 (with the sear 80) is returned to the set position by the sear spring 86. FIGS. 12 and 13 shows the sear assembly 54 not yet returned to the set position for illustrative purposes.

After the handgun 10 has fired, recoil force reciprocates the slide 14, which carries the striker 76, toward the rear. The sear member 80 allows the striker 76 to pass as it moves rearwardly by pivoting on the pivot pin 82 against the lesser force of the torsion spring 86. The sear 80 then is returned to the reset position by the spring 86 to catch and hold the striker 76 in a cocked position as the slide 14 returns forward toward the in-battery position.

Figure 14:
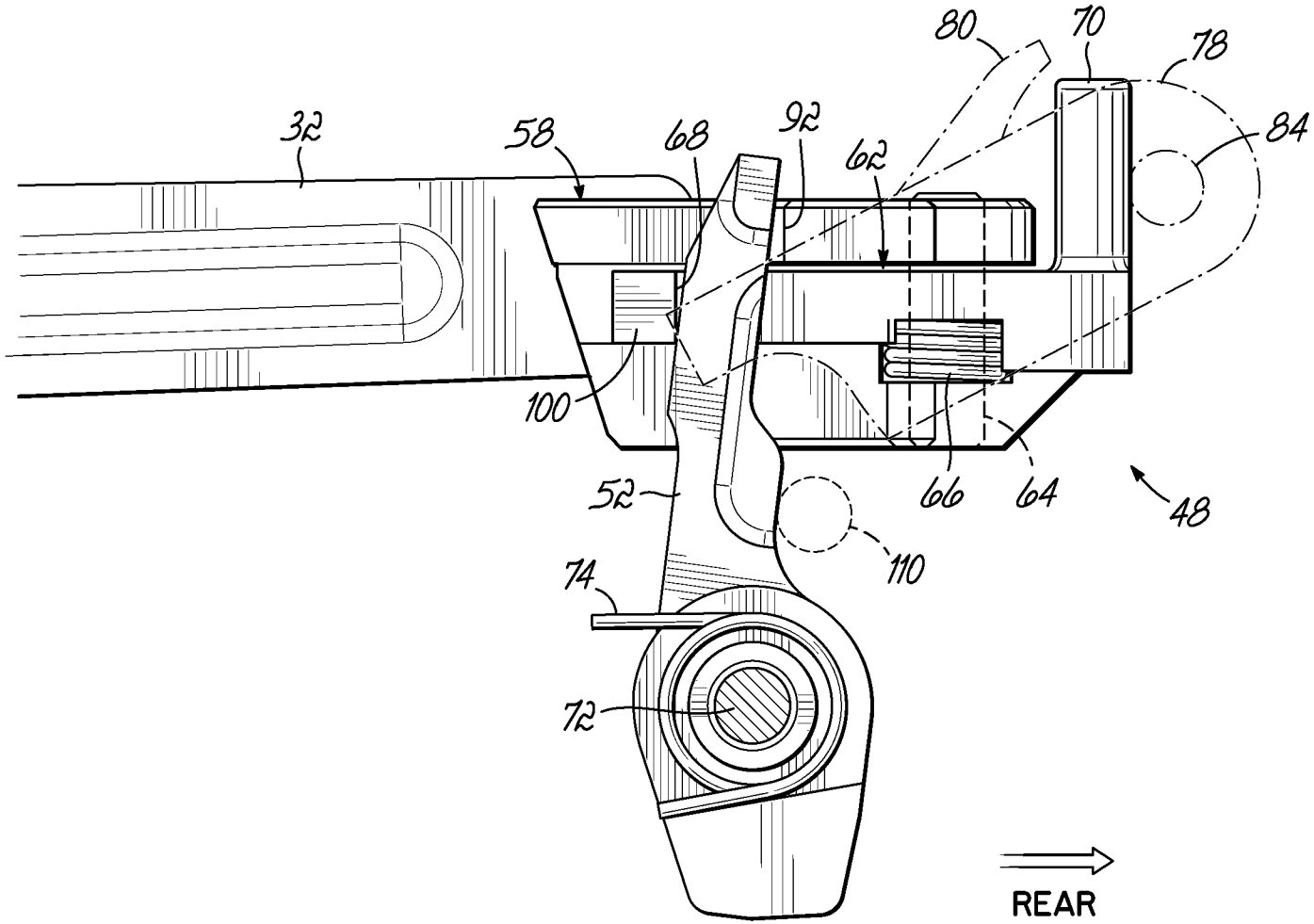
FIG. 14 is an enlarged fragmentary side view of the slide assembly and sear trip lever in the fired position.

Referring now to FIG. 14, this figure shows the slider assembly 48 having been moved rearward by the trigger bar 32. The hook portion 68 of the tripper member 62 catches the upper arm of the sear trip lever 52 to pull it rearward and disengage it from the sear carrier 78 (shown in phantom line). Further rearward movement of the sear trip lever 52 is limited by (at least) a stop surface 104 on the slider frame 58. This structure is also shown in FIG. 6. The sear trip lever 52 must then be released (disconnected from the tripper member 62) in order to return to the sear trip lever 52 to its set position and hold the sear assembly 54 in its set position while the trigger 30 remains pulled and the slider assembly 48 remains in its rearward position. This is the role of the disconnector 50, described below.

Referring again to FIGS. 3-5, as well as FIGS. 9, 10, 12, and 13, the disconnector 50 is a member pivotably mounted via a substantially vertical pivot pin 94 to the housing 36. The role of the disconnector 50 is to cause the sear trip lever 52 to be released by moving the tripper member 62 while the slider assembly 48 remains in the rearward position (as a result of the trigger 30 and trigger bar 32 being held in the pulled position by the user).

Figure 15:
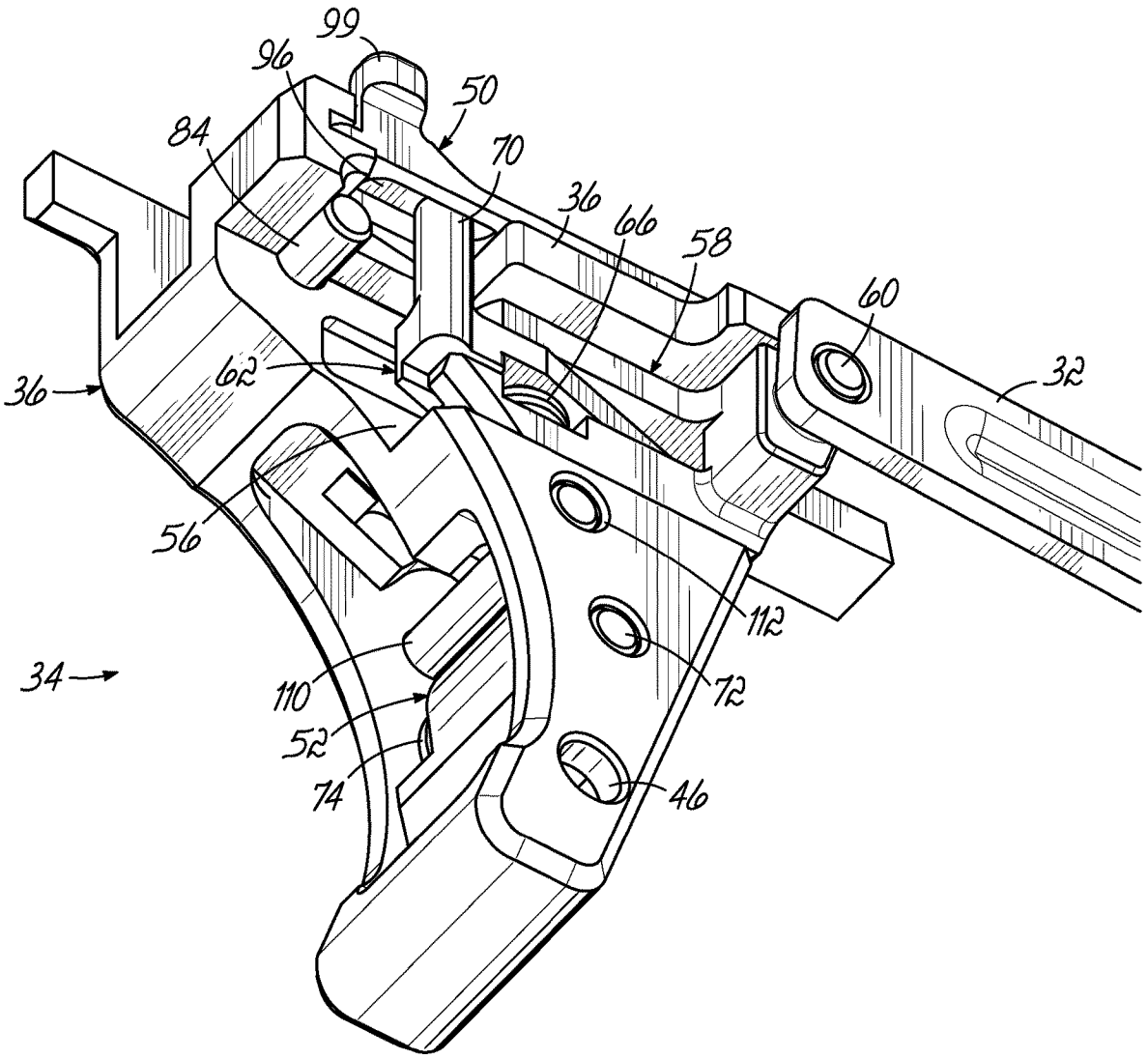
FIG. 15 is an isometric underside view of the sear/disconnector trigger mechanism.
Figure 16:
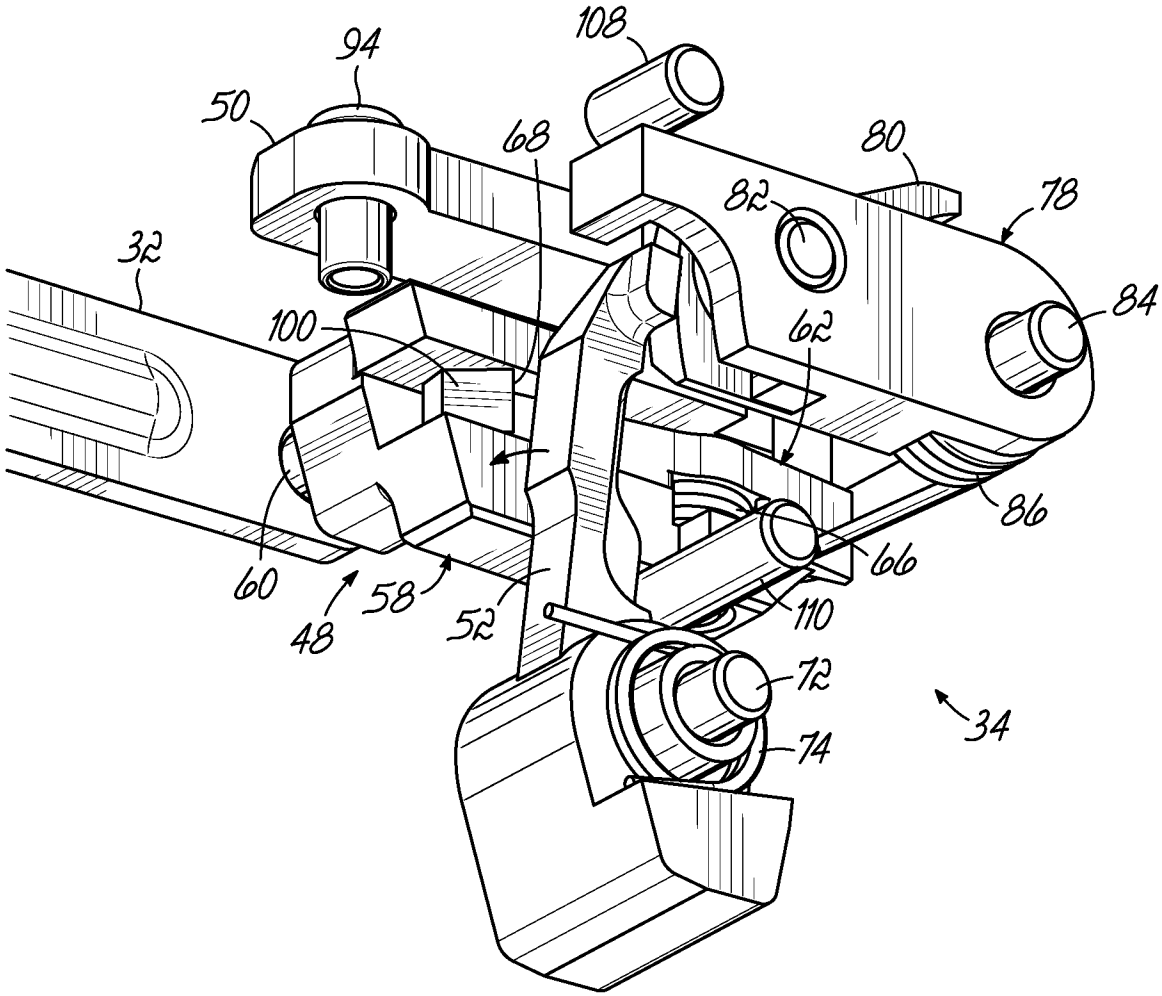
FIG. 16 is an isometric view of the trigger mechanism (with the trigger housing removed for clarity) where the sear carrier has returned to the set position, the tripper member has been retracted by the disconnector, but the sear trip lever has not yet reset.

Referring now to FIG. 15, it can be seen how the tripper dog 70 of the tripper member 62 engages with the disconnector 50. The underside of the disconnector 50 includes an elongated slot 96 that receives the tripper dog 70. This allows reciprocal forward/rearward movement of the slider assembly 48 (including the tripper member 62) relative to the disconnector 50, which is pivotally fixed on the housing 36. Lateral pivotal displacement of the rearward end of the disconnector 50, in turn, displaces the tripper dog 70, causing the tripper member 62 to pivot in the slider frame 58. This pivoting lever arm action of the tripper member 62 causes the hook portion 68 to disengage from the sear trip lever 52, releasing the sear trip lever 52 to be biased by the torsion spring 74 back to its set position (counterclockwise when viewed from the left side, as seen in FIG. 14). FIG. 16 shows the sear carrier 78 and sear member 80 returned to the set position and the disconnector 50 having pivoted the tripper member 62 to a retracted position, releasing the sear trip lever 52, but with the sear trip lever 52 not yet returned to its set position by the torsion spring 74.

Figure 18:
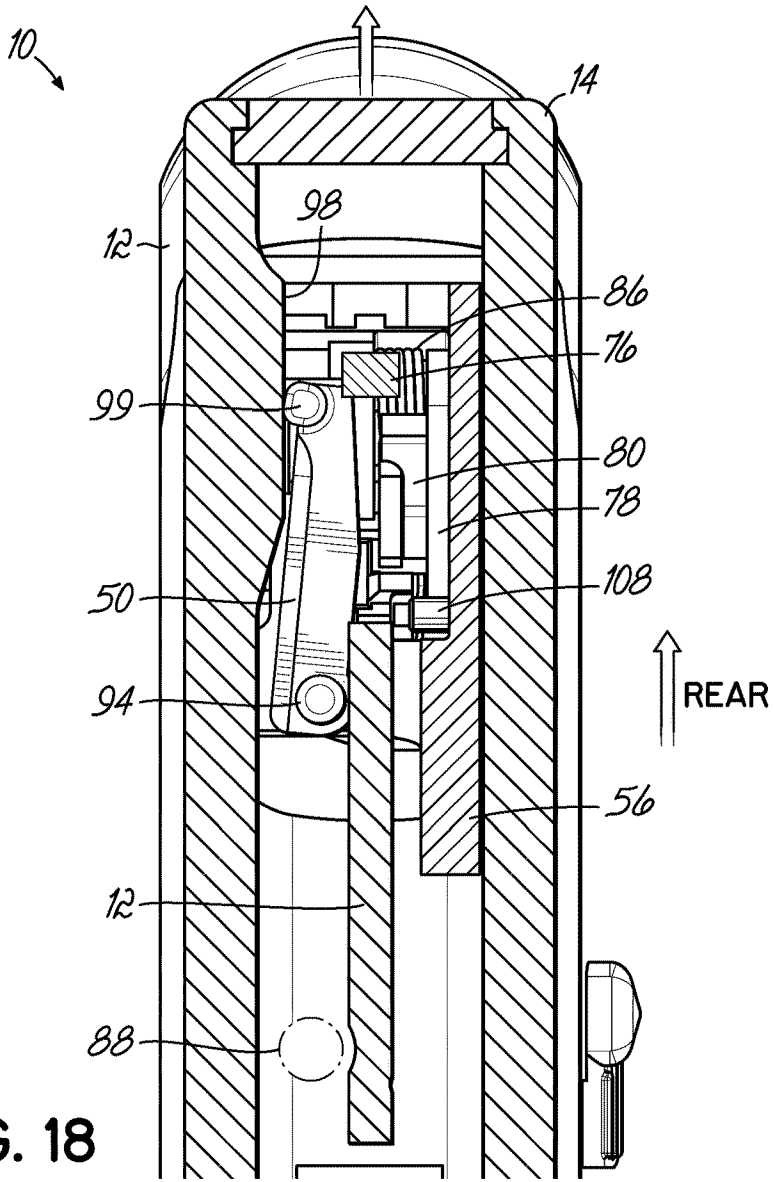
FIG. 18 is a similar top sectional view showing the slide partially retracted and the disconnector cam displacing the disconnector.
Figure 17:
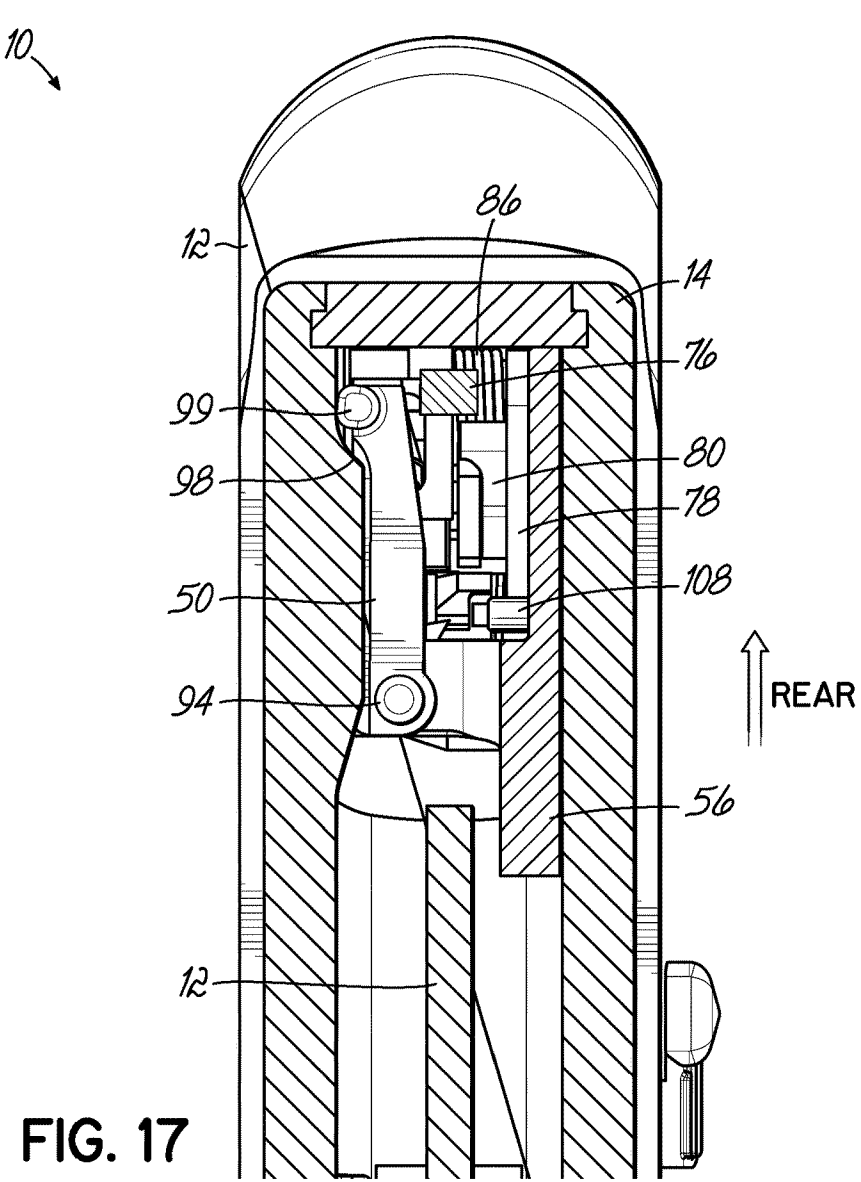
FIG. 17 is a top sectional view showing the position of the disconnector cam when the slide is in-battery.

Referring next to FIG. 17, this top sectional view shows the disconnector cam surface 98 that is part of the Glock-pattern slide 14. When the slide 14 is in-battery, as shown in FIG. 17, the disconnector 50 is in its at-rest position, biased by the tripper spring 66. Referring now to FIG. 18, as the slide 14 begins its rearward movement of the firing cycle, the cam surface 98 engages an upwardly extending dog 99 of the disconnector 50 and shifts it laterally on its pivot pin 94. Referring again to FIG. 15, this pivotal movement of the disconnector 50, through its engagement with the tripper dog 70 of the tripper member 62 causes the tripper member 62 pivot on it its axis (pivot pin 64). The "lost motion" engagement between the tripper member the tripper dog 70 and the elongated slot 96 allows this resetting action to take place regardless of the position of the slider assembly 48 (i.e., whether the trigger 30 and trigger bar 32 are pulled or in the reset position.)

After the slide 14 has returned to its forward, in-battery position (with the trigger 30 remaining held in the pulled position by the user), the striker 76 is reset and held in the cocked position by the sear member 80. The sear carrier 78 is held in the cocked position by the sear trip lever 52. The disconnector cam surface 98 allows the disconnector 50 and tripper member 62 to be moved back by the tripper spring 66. Releasing finger pressure on the trigger 30 causes it to be moved back to the set position by the trigger spring 38. This pulls the trigger bar 32 and slider assembly 48 forward and allows the striker safety 88 to return to the safe position. The hook portion 68 of tripper member 62 has a forward cam surface 100 that allows it to be displaced against the force of the tripper spring 66 as the slider assembly 48 returns forward past the upper arm of the sear trip member 52. This movement, in turn, temporarily shifts the disconnector 50, as well, without any consequential effect. Once the hook portion 68 has passed the sear trip lever 52, it resets and again engages the upper arm of the sear trip member 52. This action may give the user an audible and/or tactile 'click" to indicate the trigger has reset.

The trigger mechanism 34 can include several additional stop surfaces that enhance the safety of this embodiment. As previously described, the slider frame 58 includes a stop surface 92 that prevents rearward rotation of the upper arm of the sear trip lever 52 in the event the handgun 10 is dropped. Another stop surface 102 on the slider frame 58 (shown in FIG. 8) prevents over rotation of the tripper member 62. Rearward longitudinal movement of the slider assembly 48 is limited by interference between stop surfaces 104 on the slider frame 58 and a stop surface 106 on the trigger housing 36 (shown in FIGS. 5 and 8). The trigger housing 36 carries a stop member 108 that limits upward rotation of the sear carrier 78 by the sear spring 86. The stop member 108 can be in the form of a member (such as a pin) inserted in an opening of the housing 36, or it may be integrally formed with the housing 36. A transverse pin 110 held in opposite openings 112 of the housing 36 may provide yet another stop to limit rearward pivotal movement of the sear trip lever 52 upper arm, while surfaces of the housing 36 limit its forward rotation. Additionally, a lower extension of the sear trip lever 52 can be designed so that the mass on each side of its pivot point is substantially the same. This causes the part's center of mass to coincide with its axis of rotation (i.e., pivot pin 72). Thus, inertial forces caused by dropping the handgun 10, for example, are balanced and do not induce the sear trip lever 52 to rotate.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A single-action trigger assembly, comprising:

a pivoting trigger member;

a sear mechanism; and a trigger bar operably connecting the trigger member and the sear mechanism, the sear mechanism including a slider assembly longitudinally slidably reciprocated by the trigger bar, the slider assembly including a tripper member carried on a slider frame that, when the trigger is pulled, moves a sear trip member to allow displacement of a sear member, thereby releasing a cocked striker.

2. The trigger assembly of claim 1, further comprising a housing receivable in a handgun frame and configured to slidably carry the slider frame.

3. The trigger assembly of claim 2, wherein the sear trip member is pivotally supported on the housing.

4. The trigger assembly of claim 1, wherein the trigger bar operably connects the trigger member and the slider frame.

5. The trigger assembly of claim 1, wherein the tripper member pivots on the slider frame.

6. The trigger assembly of claim 1, wherein the sear mechanism further comprises a disconnector configured to operate the tripper member to release sear trip member when a slide reciprocates rearward.

7. The trigger assembly of claim 1, wherein the sear trip member has a pivot axis and a center of mass that substantially coincides with the pivot axis.

8. The trigger assembly of claim 7, wherein the sear trip member has a geometric center that does not coincide with the center of mass.

9. The trigger assembly of claim 1, further comprising a sear assembly, the sear assembly including a sear frame and the sear member, the sear member being pivotally mounted on the sear frame.

10. The trigger assembly of claim 9, further comprising a housing and the sear frame being pivotally supported by the housing, both the sear frame and sear member being spring biased toward a cocked position.

* * * * *